United States Patent [19]

Goldammer et al.

[11] 4,024,699

[45] May 24, 1977

[54] SLIVER RESOLVING APPARATUS FOR OPEN-END SPINNING MACHINES

[75] Inventors: Georg Goldammer, Gaimersheim; Kurt Beitzinger, Ingolstadt, both of Germany

[73] Assignee: Schubert & Salzer Maschinenfabrik Aktiengesellschaft, Ingolstadt, Germany

[22] Filed: Oct. 10, 1975

[21] Appl. No.: 621,342

[30] Foreign Application Priority Data

Oct. 11, 1974 Germany ..... 2448584
Oct. 11, 1974 Germany ..... 2448585

[52] U.S. Cl. ..... 57/58.91; 19/82; 57/58.95

[51] Int. Cl.[2] ..... D01H 1/12

[58] Field of Search ..... 57/50, 58.89–58.95; 19/83, 84, 82, 85, 86, 90, 94, 96, 97, 99, 105, 112, 115 R, 122, 128, 233, 234

[56] References Cited

UNITED STATES PATENTS

| | | | |
|---|---|---|---|
| 2,420,367 | 5/1947 | Geer et al. | 19/96 |
| 3,762,144 | 10/1973 | Didek et al. | 57/58.91 |
| 3,785,138 | 1/1974 | Rajnoha et al. | 57/58.95 |
| 3,797,218 | 3/1974 | Landwehrkamp et al. | 57/58.89 |
| 3,800,521 | 4/1974 | Doudlebsky et al. | 57/58.95 |
| 3,828,539 | 8/1974 | Croasdale et al. | 57/58.91 |
| 3,834,145 | 9/1974 | Ellingham et al. | 57/58.95 X |
| 3,839,855 | 10/1974 | Stalder | 57/58.91 |

*Primary Examiner*—John Petrakes
*Attorney, Agent, or Firm*—Robert W. Beach; R. M. Van Winkle

[57] ABSTRACT

A pressure member cooperates with a supply roller to feed sliver to a sliver resolving roller enclosed by a housing. The pressure member has a sliding surface shaped complementally with and overlapping a sliding surface on the resolving roller housing surrounding the sliver infeed opening in the housing. The sliding surfaces cooperate to seal the resolving roller housing against gaps and maintain a smooth-walled roller chamber in any adjusted position of the pressure member.

The interior wall of the housing chamber enclosing the resolving roller may have a thin liner bonded to it. The liner is of material capable of being formed to fit a non-cylindrical wall and of providing a precisely smooth wear-resistant surface. The liner has sliver infeed, fiber discharge and, optionally, dirt discharge openings through it aligned with corresponding openings in the housing wall; but the liner openings are smaller than the housing openings and, therefore, extend beyond and shield the edges of the housing openings. The resolving roller periphery and the liner cooperate to form the fiber passage between the sliver infeed opening and the fiber discharge opening. A circumferential portion of the liner immediately preceding the fiber discharge opening in the direction of fiber travel is eccentrically spaced from the roller periphery to form a widened section in the fiber passage.

25 Claims, 9 Drawing Figures

Fig. 6.
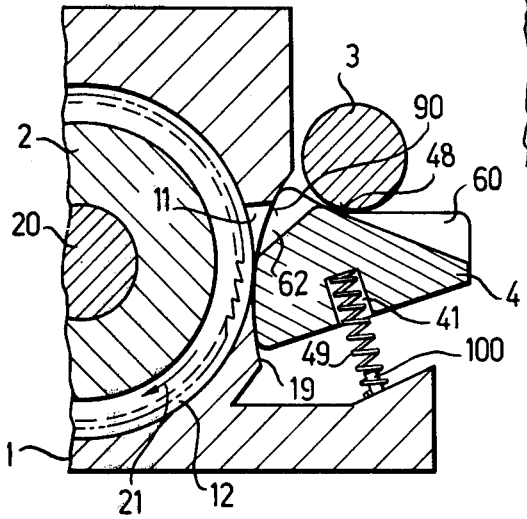
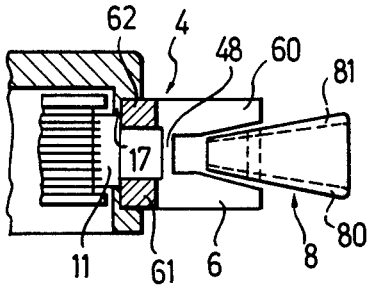
Fig. 5.
Fig. 7.
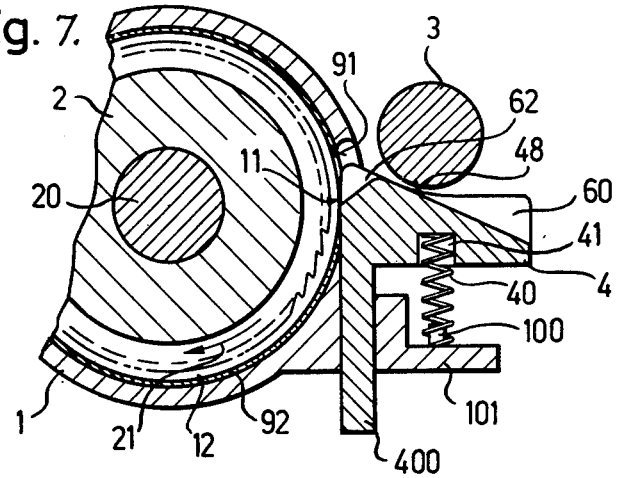

SLIVER RESOLVING APPARATUS FOR OPEN-END SPINNING MACHINES

BACKGROUND OF THE INVENTION

1. Field of the Invention

The present invention relates to resolving apparatus for open-end spinning machines having a resolving roller in a housing and a supply roller and a resiliently movable pressure member for feeding sliver through an opening in the housing to the resolving roller.

2. The Problems

Sliver resolving apparatus conventionally includes a resolving roller enclosed in a housing having a sliver infeed opening and fiber discharge opening. The wall of the housing chamber, which contains the resolving roller, normally is concentric with the roller periphery and is spaced from the periphery a sufficient distance to form a fiber feed passage. In order to assure that resolved fibers will travel smoothly at a substantially constant rate through the passage, it is essential that the chamber wall be very smooth. In order to eliminate changes in direction of fiber flow and thereby to streamline the flow, the infeed and discharge opening edges should be faired into the passage wall.

Because of the complicated shape of the housing and the passages through it and because of the need for precision measurements and high quality surface finish of fiber guiding portions of the housing, such housings have conventionally been made of nonferrous metals usually by a die-casting process. In spite of the best skill and quality control in the casting process, the housing walls all toofrequently have porous areas and shrink holes. These imperfections often are not detectable unitl the housing chamber has been machined or polished. Since pores and shrink holes materially and detrimentally affect the quality and rate of productivity of the resolving apparatus, housings so affected must be discarded, resulting in substantial waste of materials and manufacturing work. In particular the housing wall imperfections catch fine fibers, such as cotton, so that the fibers lodge in such holes and pores, resulting in waste of the trapped fibers, interference with passage of the succeeding fibers, and frequent shutdown for cleaning.

A second major problem is that roller housings which are suitable for usage wear rapidly causing decreased quality and efficiency of production over time and must be scrapped and replaced at frequent intervals. While nonferrous metals are the most reliable for die-casting and polishing, they are subject to wear and erosion, especially when used for housings which process synthetic fibers. In a threestage continuous operation of sliver feed, fiber resolving and fiber spinning using a sliver supply speed of approximately 150 meters per minute using sliver of No. 5 fineness, the hourly fiber production is about 2 kilograms. The wear rate for such production is so great that the useful life of the housings is about one year, after which they must be scrapped. Wear is especially severe at the margins of the sliver infeed, the fiber discharge and, if provided, the dirt discharge openings in the housing, which wear is accelerated when matted synthetic fibers are being processed. This type of wear results in deterioration in fiber flow into, through and out of the housing which, in turn, increases fiber waste, reduces reliability of output and increases downtime for maintenance.

The pressure member of the sliver feed mechanism for the resolving apparatus is resiliently mounted relative to the supply roller to permit movement to compensate for variations in sliver thickness or density. Sliver feed mechanism of this type is shown in U.S. Pat. No. 3,695,022, in which the direction of pressure member movement is perpendicular to a resolving roller radius through a sliver infeed opening in the resolving roller housing. In FIG. 1 of West German Offenlegungschrift 2,312,169, resolving apparatus is shown in which the movement of the pressure member is circumferentially of the resolving roller. The sliver feed mechanism is located as close to the resolving roller as possible, which is accomplished by providing a large opening in the resolving roller housing, which opening is partially covered by the supply roller and pressure member. This construction raises a third problem however. In order to permit movement of the pressure member, it has been necessary to provide some play between the housing wall and the pressure member, which has provided spaces and gaps large enough that dust, fibers and sliver pieces can escape from the resolving device and/or settle in the spaces, resulting in waste of fiber, clogging of the gaps and binding of the pressure member. The result is a material reduction in the efficiency and capacity of the resolving apparatus.

SUMMARY OF THE INVENTION

It is the principal object of the present invention to provide resolving roller apparatus which eliminates pores, gaps, rough surfaces and ambient air effects which trap or misdirect fibers between the sliver feed mechanism and the fiber discharge channel.

It is an important object to provide high surface quality on the fiber guiding housing wall and wear-resistant margins around the housing openings.

It is an additional object to provide in sliver resolving apparatus which is adaptable for use with slivers of various fibers and variable thickness and/or density, sealing means which is effective to prevent loss of the fiber or jamming of the pressure member.

It is another important object to provide such apparatus which is simple in construction and can be manufactured in an economical manner.

The foregoing objects can be accomplished by providing a thin liner covering the wall of the housing chamber in which the resolving roller is contained. The liner extends to and surrounds each of the openings in the housing which communicate with such chamber. By such construction, the normally rapid wear of the chamber wall and the margins of the openings is eliminated. The abrupt edges of the openings, which are required to direct positively the incoming sliver to streamline the fiber flow through the chamber and to direct accurately the outgoing fibers, can be provided in a simple manner by extending the liner opening margins beyond the housing opening edges so that the thin edges of the liner ports constitute the opening margins. In this way, special shaping of the opening margins and entrapment or misdirection of the fibers at the openings is avoided. Such construction also shields and protects the housing opening margins from wear by assuring that fiber contact will be solely with the liner.

The effectiveness of the resolving apparatus is further enhanced if the housing chamber wall deviates from the conventional cylindrical shape. When machining or polishing of the chamber wall is necessary, as in the past, it has not been practical to form the chamber with eccentric portions. However, with the present invention, it is possible and desirable to provide an indentation in the housing wall of substantial extent circumferentially of the resolving roller and terminating at the fiber discharge opening. Such indentation widens the fiber passage, facilitates separation of dirt from the fiber stream, facilitates disengagement of the fibers from the periphery of the resolving roller, and thereby increases fiber output by reducing the amount of fiber which is carried past the discharge opening by the resolving roller and recirculated through the chamber.

In order to provide such an indentation or eccentricity in the chamber wall, the liner should be made of flexible, deformable material which is easily formed to the contour of the noncylindrical chamber wall. While a circumferentially endless sleeve could be used as the liner, the insert can be easily adapted to such contours if it is a metal strip of finite length. The seam formed between opposite ends of the strip when it is placed in chamber lining position are preferably located between the fiber discharge opening and the sliver infeed opening beyond the discharge opening and ahead of the infeed opening in the direction of fiber travel. The liner should be bonded to the chamber wall, which may be done by welding or soldering, but the liner is preferably bonded to the housing by adhesive.

Sealing means for the housing sliver infeed opening surrounding the sliver feed mechanism includes complemental sliding surfaces on the resolving roller housing and the pressure member of the sliver feed mechanism, which sliding surfaces surround the infeed opening. The sliding surfaces may be substantially concentric with the adjacent arc of the resolving roller or may be planar and disposed substantially perpendicular to a resolving roller radial plane passing through the housing sliver infeed opening.

In order to provide a simple construction for guiding the pressure member toward and away from the supply roller, one of the complemental sliding surfaces is formed in the housing wall. It is preferred that the sliding surfaces have a curve concentric with the inner surface of the housing wall embracing the resolving roller. It is further preferred that the housing sliding surface face away from the resolving roller to facilitate disassembly for maintenance of the resolving apparatus and to simplify the construction for maintaining the sliding surfaces in intimate contact. However, a suitable arrangement utilizes the inner housing wall portions facing toward the resolving roller around the infeed opening as the housing sliding surface, and the pressure member may carry a shield which is received in the housing and slides on such inner housing wall. The margins of the shield, at least the margins movable circumferentially of the resolving roller, are tapered toward the housing wall to provide a substatially streamlined surface enclosing the resolving roller. To dispose the sliding surfaces facing away from the resolving roller, as preferred, while maintaining the pressure member as close to the resolving roller as possible, the port of the thin liner which corresponds to the sliver infeed opening through the housing wall is substantially samller than the housing opening so that the liner extends well beyond the edges of such housing infeed opening; and the liner port margin on the side facing away from the resolving roller forms the sliding surface.

Although the sliding surface of the pressure member can be maintained in engagement with the housing sliding surface by magnetic force or by rail and track means engaged with a slide fit, it is preferred to use resilient means, such as springs or pneumatic plungers to maintain the sliding surfaces in constant intimate contact. While a plurality of resilient elements could be provided, at least one for urging the pressure member toward the supply roller and at least one other for maintaining sliding surface engagement, a single resilient element can be provided for the pressure member disposed in a position whereby it has a component of force toward the supply roller and a component of force toward the housing sliding surface. If a lever is provided for pressing the pressure member away from the supply roller to effect interruption of sliver feed, it is preferred that two resilient members be provided. One of such resilient members reacts between the housing and the pressure member to urge the pressure member toward the supply roller; the other resilient member reacts between the feed-interrupting lever and the pressure member to maintain the sliding surfaces in contact. It is also desirable to provide a stop to limit movement of the pressure member toward the supply roller to avoid wear of the pressure member and/or the supply roller when no sliver is being fed, especially when a feed-interrupting lever is not supplied.

It is especially desirable to provide a dirt discharge port in the liner between the sliver infeed port and the fiber discharge port in the direction of fiber travel, which discharge port has a dirt separation lip. With such an abruptly edged dirt discharge port, separation of dirt and debris from the fiber stream is quite effective. If the dirt expulsion lip is located immediately ahead of the channel wall indentation, the combination of the reduction in velocity of the material passing through the chamber and the greater mass of the dirt cooperates to make the dirt separation substantially complete.

Due to the features of the present invention no special demands are made on the die-cast housing, and those having porous areas or shrink holes can be utilized. The surface of the housing chamber wall need not be polished, but need only be lightly worked to remove burrs and make the surface generally smooth. Since the walls of the chamber are covered by the liner and the edges of the openings to the housing are shielded by the liner, no special treatment of the housing opening edges is necessary. The liner is made of material which is easily worked to form it to the chamber contour and to form the liner ports, but is also highly wear-resistant or can be treated to make it wearresistant without special problems.

BRIEF DESCRIPTION OF THE DRAWINGS

FIG. 5 is a fragmentary top plan of the infeed portion of the resolving apparatus with parts in section.

FIG. 6 is a vertical section similar to FIG. 3 showing a further embodiment of the sliding surface construction, parts being broken away.

FIG. 7 is a vertical section similar to FIG. 3 showing still another embodiment of the sliding surface construction, parts being broken away.

DETAILED DESCRIPTION

Figure 1:
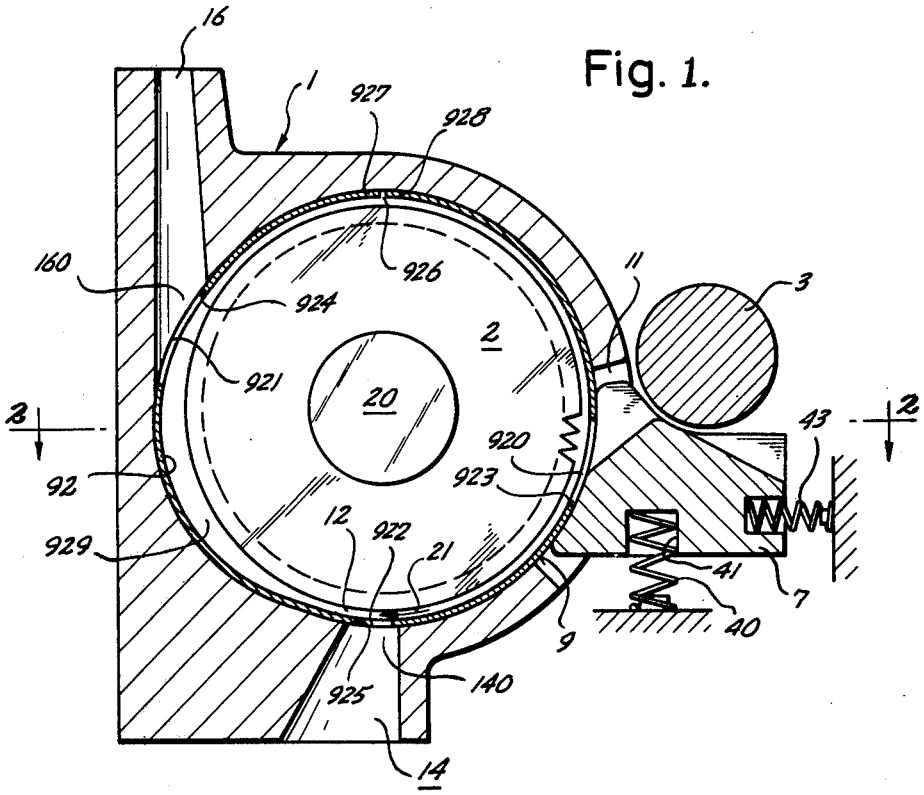
FIG. 1 is a vertical section through the resolving apparatus transversely of the resolving roller axis illustrating liner means of the present invention.
Figure 2:
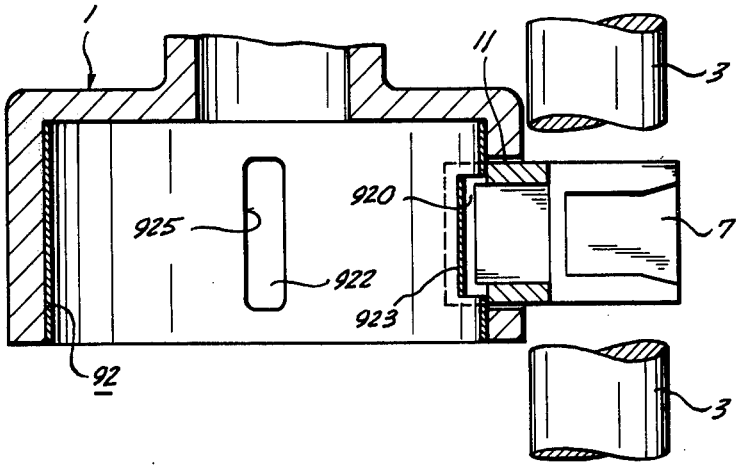
FIG. 2 is a horizontal section taken on line 2—2 of FIG. 1.

Sliver is conventionally resolved into discrete fibers which are supplied to an open-end spinning device. Typical resolving apparatus includes a housing 1 enclosing a resolving roller 2 rotatable by a shaft 20. Sliver is fed to the resolving roller 2 through infeed opening 11 in the wall of housing 1 by a supply roller 3 and cooperating pressure member 7 resiliently biased toward the supply roller. The biasing element for pressure member 7 is usually a compression spring 40 having one end seated on the housing 1 or the spinning machine frame and the other end seated in a recess 41 in the pressure member.

Housing 1, which is conventionally manufactured as a die casting of nonferrous metal, preferably is made of aluminum or zinc by an injection molding process. The housing has a plurality of openings at least including a sliver infeed opening 11 adjacent to the feed mechanism 3,7 and a fiber discharge opening 160 communicating between housing chamber 12 and fiber discharge channel 16. A dirt discharge opening 140 communicating between chamber 12 and a dirt separation channel 14 is commonly provided. Fiber is resolved from the sliver by needles, teeth, or other appropriate projections on the periphery of roller 2, and then guided through the passage between the roller periphery and the wall of chamber 12 in the direction of arrow 21 to the fiber discharge opening. The circumferential fiber-guiding wall of the chamber 12 is, in accordance with the present invention, formed by a thin wear-resistant liner 92, which has ports 920, 921 and, optionally, 922 through it, aligned with the housing openings 11, 160 and, optionally, 140, respectively. While the present invention would afford a remarkable improvement over prior housing construction if the liner ports 920, 921 and 922 were the same size as the corresponding housing openings 11, 160 and 140, it is preferred that each liner port be smaller than its corresponding housing opening. By this construction the wear-resistant liner 92 extends beyond and shields the softer margins of the housing 1 and deters wear of these housing areas.

The liner can be made of various materials. Carbon steel can be used advantageously, but easier workability of the liner is afforded by use of aluminum which is treated to increase its wear resistance, for example by anodizing or coating it to provide a wearproof surface and wearproof port edges. The ports 920, 921 and 922 are made in the liner prior to the aforesaid treatment by conventional processes such as by drilling or milling. Because the liner is thin, the housing wall thickness is not appreciably increased, so that the liner port margins do not need special shaping to avoid interference with streamlined flow between the feed mechanism 3,7 in fiber discharge channel 16, through the chamber 12.

By having the liner port margin portions which are downstream of fiber travel extend upstream beyond the corresponding housing opening margins, a smooth but sharp edge is provided to facilitate separation of the dirt at the discharge port 922 and stripping of fibers from the projections of roller 2 at a port 921. The liner 92 is secured in the housing in an appropriate manner to maintain the aligned openings and ports in proper relationship. The liner can be bonded to the housing by welding or soldering, but it is preferred that liner 92 be adhesively bonded to housing 1.

The liner 92 is slid into the housing chamber 12 through one axial end before such end is closed by a cover. The liner could be provided as a seamless tube. The liner material should be readily deformable so that it can be easily shaped to conform to the wall of chamber 12 when such chamber is deliberately not cylindrical. It is preferred that the fiber passage through chamber 12 be widened preceding the outfeed port 921, such widened portion being indicated at 929. Such widening of the passage in the direction of fiber travel, as indicated by arrow 21, facilitates release of the fibers from the projections on the resolving roller 2. This desired shape of the circumferential fiber feed passage could be formed by the liner 92 having a principal diameter of cylindrical housing chamber and having an outward bulge in the liner arcuate portion immediately preceding outfeed port 921. Alternatively, the housing 1 can be cast with an arcuate recess in the normally cylindrical chamber wall, and the liner 92 can be shaped to conform to such housing chamber wall, so that the liner is contiguous with and supported by the housing wall, as shown in FIG. 1.

When a dirt separation channel 14 is provided, a substantially complete separation of dirt from the fiber is effected if the margin portion forming the separating lip 925 on the downstream side of liner dirt discharge port 922 extends into the housing dirt discharge opening 140 by a distance equal to the radial width of the pasage immediately preceding the widened passage portion 929 between the resolving roller periphery and liner 92. The widened portion 929 preferably extends substantially from the dirt discharge port 922 to the fiber discharge port 921. With such construction, dirt carried into the housing with the sliver, which dirt normally has greater mass than the resolved fibers, will tend to drop through port 922. The change in velocity of the circumferential air stream will reduce the circumferential momentum of the dirt particles so that the gravitational force on the particles tends to dominate and cause the dirt to change direction. The dirt separation lip 925 separates the circumferential airflow carrying the fibers from the dirt discharge channel 14 to reduce turbulence at the downstream edge of port 922 and also prevents dirt particles hitting the adjacent wall of channel 14 from rebounding into the fiber passage.

To provide a particularly simple construction for a resiliently deformable liner, a spring steel strip may be used having a length equal to the perimeter of the housing chamber wall circumferetially of resolving roller 2. The ports 920, 921 and 922 can be formed by stamping the liner strip. With maintenance of close tolerances in the strip length, the distance between the strip ends 927 and 928 when the strip is bent to fit the housing wall will be sufficiently small that the strip ends can be disposed at any desired location circumferentially of the wall. For example, if the strip ends are located between dirt discharge port 922 and fiber discharge port 921, the seam 926 between the strip ends 927 and 928 would be located in the widened portion 929 of the passage, making conformity with this nonconcetric portion of the housing wall more easily effected. Less precision in the strip length can be tolerated if the seam 926 is between fiber discharge port 921 and sliver infeed port 920, as shown in FIG. 1, since any fiber traveling between these two ports is that which was not separated from the projections on the resolving roller periphery ahead of the fiber discharge port. Consequently, such fiber that is not expelled into channel 16 is more likely to be carried past the seam on the roller peripheral fittings than it is to be free floating and in danger of lodging in seam 926.

Figure 3:
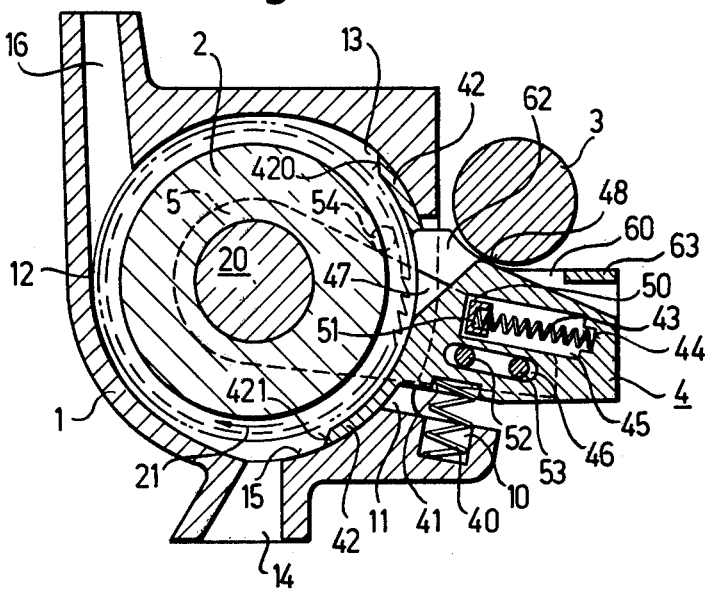
FIG. 3 is a vertical section through resolving apparatus showing a different embodiment of the sliding surface construction of the present invention.

Construction for sealing the housing opening 11 is shown in all the figures but is described in detail with reference to FIGS. 3 through 9. In FIG. 3, the pressure member 4 is carried by a lever 5 which is mounted to swing about the axis of resolving roller 2, such as by a sleeve loosely mounted on roller drive shaft 20. Consequently, the pressure member 4 is mounted for movement toward and away from supply roller 3 along an arcuate path concentric with the resolving roller 2. It is preferred that the spring seat recesses 10 and 41 be aligned with each other perpendicular to lever 5 so that the line of force of compression spring 40 is substantially tangential to the arcuate path through which the nip line between supply roller 3 and pressure controvel member 4.

In accordance with the embodiment of the present invention shown in FIG. 3, the annular passage formed between the wall of chamber 12 and resolving roller 2 is widened near both sides of infeed opening 11 to form an eccentric extension 13 of the annular passage. The portion of wall 15 defining extension 13 forms a sliding surface surrounding the infeed opening 11 on which a shield 42 carried by pressure member 4 can slide as the pressure member 4 moves toward and away from roller 3 in response to the force of compression spring 40 and the wedging force of thickened portions of the sliver passing the nip line 48 between supply roller 3 and pressure member 4.

Shield 42 extends both axially and circumferentially of resolving roller 2 a sufficient extent to close effectively the opening 11 in housing 1. The shield side adjacent to wall 15 is formed complementally with the wall and is finished to act as a sliding surface. Both the housing chamber sliding surface and the shield sliding surface are curved concentrically about the axis of the resolving roller 2. A passage 47 through the shield provides access for the sliver to the housing chamber 12. The preferable circumferential extent of the shield 42 in the direction of arrow 21 is such that shield edge 421 terminates just short of the dirt discharge port 14 when pressure member 4 is in its lowermost limit position. The upper and lower circumferential edges 420 and 421 of shield 42 are preferably tapered toward chamber wall 15 to streamline the annular passage for preventing fiber deposits and avoiding eddies in the airstream transorting the fibers through the chamber 12 toward discharge channel 16.

In order to maintain the sliding surfaces of wall 15 in chamber extension 13 and of shield 42 in intimate sliding contact, a second biasing member in the form of compression spring 43 is provided. A slot 45 in pressure member 4 is disposed with its length extending radially of resolving roller 2. An arm 50 carried by lever 5 extends into slot 45, is spaced from, but adjacent to, its radially inner end and has a recess 51 forming a seat for one end of spring 43. A recess 44 in the radially outer end of slot 45 seats the opposite spring end. Pressure member 4 is guided for radial movement relative to lever 5 by a pair of spaced pins 52 and 53 fixed on lever 5 which are received for sliding movement in a radially-extending slot 46 in pressure member 4.

The apparatus described above and shown in FIG. 3 operates to confine the fibers from the sliver so that all of such fibers enter resolving chamber 12 and either remain in the chamber or are discharged through channel 16. In apparatus without the present invention, fibers escape because of the necessarily large opening 11 in the housing to allow for movement of pressure member 4 and because of local turbulence in the housing chamber near the opening 11 and the moving pressure member 4 which interfere with the desired smooth unidirectional air current from the feed mechanism 3, 4 to the fiber discharge channel 16 necessary for maximally efficient utilization of fibers. Also, fibers subjected to the localized uncontrolled airflow were likely to be deposited on the feed mechanism and to become trapped or otherwise accumulate, which necessitates frequent cleaning to maintain smooth and quick response of the movable pressure member 4 to variations in the sliver.

In the embodiment of FIG. 3, sliver is introduced to the nip line 48 between supply roller 3 and pressure member 4, whereby the pressure member is wedged away from roller 3 in opposition to the force of spring 40 and, through the connection of pins 52 and 53 received in slot 46 swings lever 5. Supply roller 3 is driven to feed the sliver clamped between it and pressure member 4 through fiber supply opening 47 in shield 42 to roller 2, which resolves the sliver into individual fibers. The fibers are transported by the air current created by rotation of roller 2 and by the underpressure existing in the open end spinning rotor (not shown) along the annular passage and into fiber discharge channel 16, which directs the fibers onto the spinning rotor. The and debris introduced with the silver that has greater mass than the fibers drops through the dirt discharge port 14.

Fibers which have not dislodged from the projections or teeth on the resolving roller in time to be directed through discharge channel 16 continue around the annular passage in chamber 12, and by the centrifugal force operating on them are urged toward opening 11. However, shield 42 closes the opening 11 and forms a continuation of wall 15 to guide such fibers around the resolving roller chamber again. Those fibers which tend to move out through opening 47 through the shield will be caught by the incoming silver and by the sucked-in air and fed back to chamber 12. Fiber cannot be trapped between the shield and wall 15 because their respective sliding surfaces are held in constant intimate contact in any swung position of pressure member 4 by compression spring 43 urging the pressure member and shield 42 radially outward. Such outward movement relative to lever 5 is permitted by slot 46 carrying pins 52 and 53.

In order to confine further both the fibers which tend to be discharged through passage 47 and the fibers which may slough off of the silver as a result of the air currents created by supply roller 3 and ambient air currents, additional funneling structure may be provided on the infeed and outfeed sides of the nip line 48, as shown in FIGS.3 and 5. A channel between nip line 48 and feed passage 47 of shield 42 is formed by lateral walls 61 and 62 and the downwardly and inwardly inclined upper surface of pressure member 4. Supply roller 3 is located quite close to housing 1 to deter upward escape of sloughed fibers. Moreover, fibers propelled outwardly through opening 47 form the chamber 12 will have a substantially downward momentum caused by the sucked-in air stream so that their impact against the downwardly and inwardly inclined surface of the pressure member 4 will tend to return them to the resolving roller chamber. On the infeed side of supply roller 3 opposite resolving roller 2, a second funnel is formed by lateral wall 6 and 60, upper wall 63 and the upwardly and inwardly inclined surface of pressure member 4. All of the funneling components 6, 60, 61, 62 and 63 are carried by pressure member 4. The upper edges of lateral wall 62 and 63 are contoured to be closely adjacent to the periphery of supply roller 3 when member 4 is in its position closest to the supply roller to minimize the lateral gaps between roller 3 and housing chamber 12. The sides 6, 60 of the outer funnel are tapered to accomodate a supplemental frustoconical supply funnel which may be supplied to extend the zone of silver confinement as desired. In order to facilitate prevention of fiber escape during the silver transport across the pressure member, the inner sides of walls 6 and 60 near the nip line 48 are arranged closer to each other than the inner sides of walls 61 and 62.

Since supply roller 3 is continuously driven, often by drive means which is common to a plurality of resolving devices, when sliver feed to the supply roller 3 is interrupted for any reason the pressure member 4 is urged by spring 40 against the roller periphery so that the roller rubs on the pressure member causing increased wear. To eliminate this source of wear, a stop 54 shown in broken lines in FIG. 3 is carried by housing 1 to engage the upper side of lever 5 and, thereby, to limit the extent to which lever 5 and pressure member 4 supported on the lever can move toward supply roller 3. The stop 54 shown in FIG. 3 is a pin projecting from the housing in a direction parallel to the axes of rollers 2 and 3. Alternatively, the stop could be a set screw disposed tangentially of the arc along which the stop-engaging point on lever 5 is swingable so that the limit position can be adjusted as desired.

Figure 4:
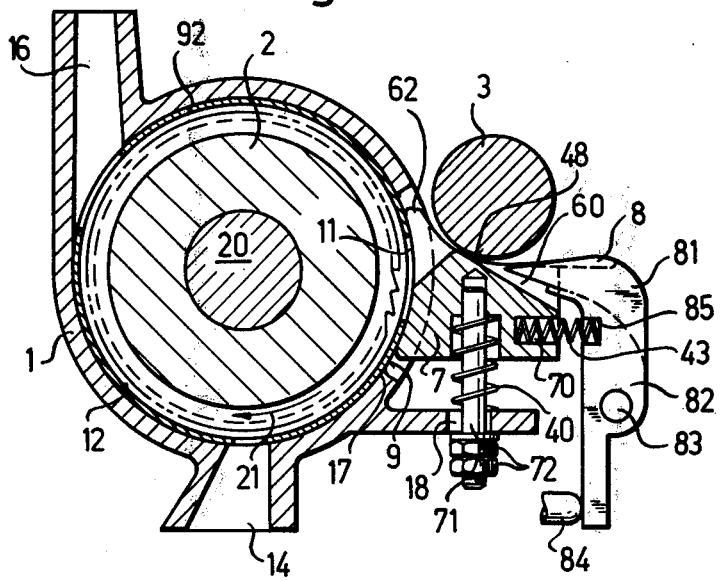
FIG. 4 is a vertical section similar to FIG. 1 showing another embodiment of the sliding surface construction utilizing the liner means.

The preferred embodiment of the invention is shown in FIG. 4. In contrast to the construction shown in FIG. 3 wherein the housing sliding surface was on the interior housing wall adjacent to and faced toward resolving roller 2, the sliding surface 9 in FIG. 4 is formed on the exterior side of liner 92 remote from roller 2, so that the sliding surface faces away from such roller. The principal housing wall on the feed mechanism side has an opening 11 of an arcuate extent greater than the infeed port through liner 92 so that a portion of the outer wall 17 of the liner extends into opening 11 and forms sliding surface 9. In this instance, the pressure member 7 does not include a shield. Instead, its face nearest resolving roller 2 is shaped complementally to housing sliding surface 9 and forms the pressure member sliding surface. As in the apparatus of FIG. 3, again both the housing sliding surface 9 and the pressure member sliding surface are curved concentrically about the axis of the resolving roller 2. While the pressure member might be constructed to use the exterior surface of the adjacent wall of housing 1 as a sliding surface, the use of the thin liner 92 with the sliding surface 9 on the liner exterior side permits a construction whereby the pressure member can be located closer to the resolving roller 2 and the annular passage in chamber 12 so that the downwardly and inwardly inclined surface of the pressure member forms a positive guide for sliver directly into the annular passage and onto the projections on the periphery of the resolving roller.

It is preferred that the infeed opening 11 be of greater extent both circumferentially and axially of the resolving roller than is the port through liner extension 17. The sliding surface 9 is of a size to surround the infeed opening 11 and the pressure member 4 is of an extent so that its sliding surface contacting the sliding surface 9 of the housing overlaps the edges of the port in extension 17 in both the axial and circumferential directions in all adjusted positions of pressure member 4. Consequently fibers cannot escape from chamber 12 at the location of infeed opening 11 and no corners are formed around the infeed opening in which fibers might become lodged.

As in FIG. 3, the pressure member 4 is biased towards supply roller 3 by a compression spring 40 having its line of force substantially tangential to the arc through which member 4 can travel. In this instance, compression spring 40 encircles a pin 71 which has lock nuts 72 adjustable to alter the limit of the movement of pressure member 4 toward roller 3 effected by such spring. Pin 71 is loosely embraced by an aperture 18 in a projection of housing 1 so that the margin of such aperture forms one spring seat. The end of pin 71 remote from lock nuts 72 is seated with a press fit in an aperture of pressure member 7 so that the pin moves with the pressure member. Therefore lock nuts 72 form a stop of alternative construction to the stop pin 54 of the apparatus shown in FIG. 3. Also the pressure member 4 is biased toward housing 1 by a compression spring 43 having its line of force substantially perpendicular to that of spring 40 to maintain the sliding surfaces in intimate contact. Aperture 18 is elongated in the direction of the force of spring 43 to permit movement of pin 71 transversely of its axis corresponding to movement of pressure member 4 in response to the force of spring 43.

The construction of FIG. 4 operates to guide and confine the fibers in chamber 12 and prevent their escape from the chamber in the same manner as described in connection with FIG. 3. Again, side walls 61 and 62 can be provided spaced apart a distance less than the axial extent of the port 11 through liner extension 17 to prevent deposit of fibers on the outer side of the extension. Also, the funnel 6, 60 on the infeed side of supply roller 3 can be provided, as described above and shown in FIG. 5. This funnel may receive an auxiliary frustoconical funnel 8 which has sides 80 and 81 converging toward each other and toward the funnel outfeed end sufficiently for the funnel 8 to be received between sidewalls 6 and 60 of the funnel carried by pressure member 4 or 7.

The auxiliary funnel 8 may be supported from a sliver clamping lever 82 of conventional type. Such a lever is operable between the sliver feed position shown in FIG. 4 and a position in which its upper end bears against the upper surface of pressure member 7 to press such member in opposition to the force of spring 40 to interrupt feed of sliver and to clamp the sliver end portion against the pressure member for the duration of the feed interruption. Clamping lever 82 is swingable about its pivot 83 from the position shown in FIG. 4 into its sliver clamping position by a plunger 84 operable by electromagnetic or pneumatic means (not shown). When the plunger 84 is retracted into its position in FIG. 4, it forms a stop to limit the extent of clockwise swing of the lever. Biasing spring 43, which maintains the sliding surfaces in contact, may also serve to bias lever 82 into its sliver feeding position when plunger 84 is retracted. For this purpose, spring 43 reacts between the bottom of its seat recess 70 in pressure member 7 and the bottom of seat recess 85 in clamping lever 82.

As indicated by the above description, positive control of fibers fed from a sliver into the chamber 12 of resolving roller housing 1, the confinement of fibers to prevent their escape back through opening 11 and the elimination of corners, gaps or crevices in which fibers otherwise may be trapped and accumulate, while providing freedom of movement of the pressure member 4 toward and away from supply roller 3 in response to variations in thickness of the sliver, are all accomplished by the cooperation of complementally shaped sliding surfaces on the housing 1 and the pressure member 4. As indicated, the housing sliding surface may be the interior wall side adjacent to and facing toward the resolving roller or the exterior side which is opposite the resolving roller and faces away from it. The pressure member may be carried by a lever 5 or may be substantially free-floating on its resilient biasing means. The biasing means have been shown as compression springs, but tension springs, hydraulic piston and cylinder units or other resilient means could be substituted with suitable changes in mounting. In each case, the result is to close the opening 11 in housing 1 so that no fibers can escape regardless of the position assumed by pressure member 4 in response to sliver thickness variations; therefore, all fibers are delivered to the operative region of resolving roller 2. The mounting of springs 40 and 43, pin 71 or connection means 46, 52, 53 and the relationship of thin wall extension 17 with respect to the housing wall 1 all are constructed to assure accurate guidance of pressure member 4 toward and away from resolving roller 2 for sealing the housing chamber 12.

While the complemental sliding surfaces of the above embodiments have been arcuate and concentric with the periphery of resolving roller 2, the sliding surfaces may have other shapes and two alternative examples are shown in FIGS. 6 and 7.

In FIG. 6, the housing exterior wall has a concave sliding surface 19, which cooperates with a complementally convex sliding surface 90 on the pressure member 4. Such sliding surfaces form arcs about an axis at the side of such surfaces remote from the axis of resolving roller 2. A feed channel between supply roller 3 and housing member 12 is formed by sidewalls 6, 60 and a downwardly and inwardly inclined channel bottom on the pressure member 4, as described previously. The end of the channel through the convex sliding surface opens above its midpoint so that fibers discharged from the feed channel have a momentum substantially in the direction of fiber travel through the annular passage in chamber 12, as indicated by arrow 21. Such disposition of the feed channel also permits the upward extension of the lower portion 19 of the housing sliding surface to be quite thin at the opening 11 through the housing wall.

With this configuration of the sliding surfaces, the two compression springs 40 and 43 can be replaced by a single compression spring 49 disposed so that its line of force passes between the axes of resolving roller 2 and supply roller 3 and is substantially perpendicular to a line connecting such roller axes. The force of spring 49 resolves into a component urging pressure member 4 toward the axis of supply roller 3 and a component urging such member toward the axis of resolving roller 2 and, therefore, into engagement with sliding surface 19 of the housing 1. A spring seat recess 41 for one end of spring 49 is provided in pressure member 4, and a pin 100 projecting from a spring reaction surface on a projection of housing 1 extends into the other end to maintain the spring in proper position.

That the sliding surfaces need not be arcuate is shown by the embodiment in FIG. 7. In this instance, planar sliding surfaces are disposed substantially perpendicular to a resolving roller radial plane passing through infeed opening 11. While a spring 43 could be provided for maintaining the sliding surfaces in engagement, FIG. 7 shows a rail 400 slidable in a complemental track aperture through guide 101 projecting from housing 1. The rail and track aperture preferably have a slide fit and guide 101 may have a synthetic or plastic insert in the track aperture to reduce sliding friction and provide precise reciprocable guiding for the pressure member. A spring 40 seated in pressure member recess 41 and on pin 100 carried by guide 101 provides the biasing force toward supply roller 3.

Figure 8:
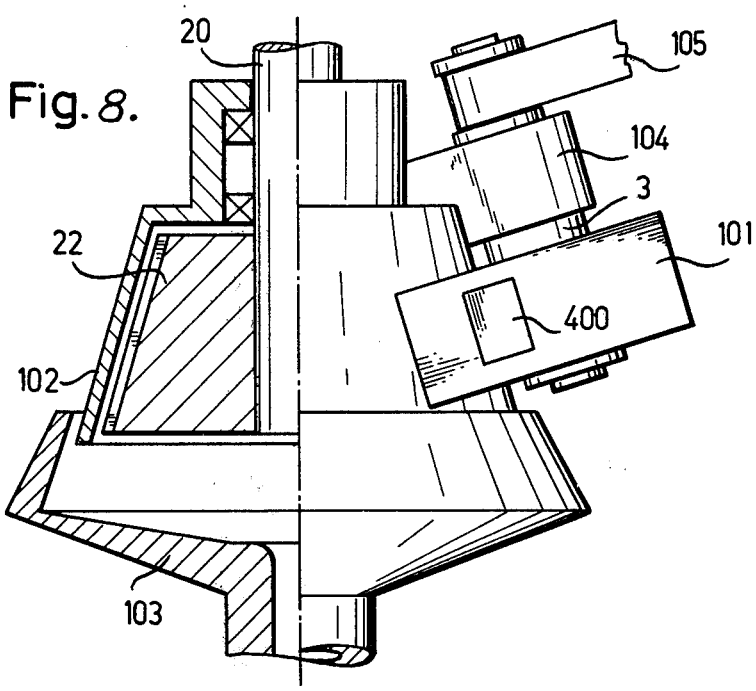
FIG. 8 is a side elevation of resolving apparatus in conjunction with a spinning rotor, with parts in section, showing the application of the sliding surface construction to a modified type of resolving apparatus.

FIG. 8 illustrates the adaptability of the present invention to resolving apparatus having a frustoconical, rather than cylindrical, resolving roller 22 enclosed by a housing 102. The frustoconical housing 102 projects partially into a spinning rotor 103 so that resolved fibers slide along the inner wall of housing 102 as a result of the dominant air current and are transferred directly onto the interior wall of spinning rotor 103. The supply roller 3 is mounted by a bearing 104 with its axis substantially parallel to a surface element of the roller 22 and is driven by a belt 105. The type of pressure member shown in FIG. 7 is particularly suitable for this application, the bottom plan view of its rail 400 and housing mounted guide 101 being shown.

Figure 9:
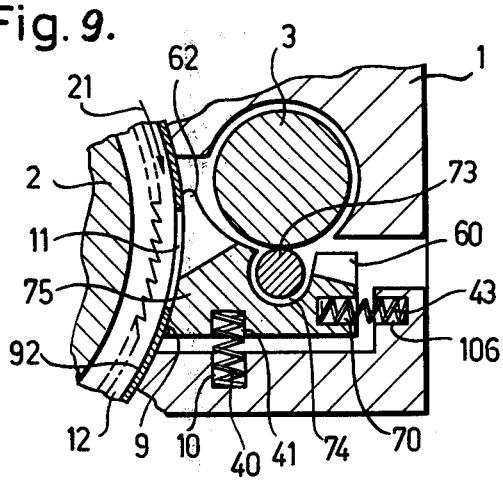
FIG. 9 is a fragmentary vertical section through the sliver supply mechanism showing the application of the present invention to a modified type of sliver feed device.

In FIGS. 3 through 7, the pressure member 4 or 7 has been shown having a substantially planar surface cooperating with the supply roller to form the sliver feed nip line 48. FIG. 9 shows an embodiment of the present invention which is adapted for use with a cooperating roller 73. Since such a roller cannot cooperate with the sliding surface 9 of the housing 1, it is carried in a complementally arcuate recess 74 in a body 75 which is otherwise of configuration similar to the pressure members 4 and 7. The sliding surface biasing spring 43 is mounted similarly to the arrangement of FIG. 4, but is shown as reacting between the pressure member body 75 and the bottom of a housing recess 106 instead of recess 85 of clamping lever recess 82.

The present invention simplifies the manufacture of housings for resolving apparatus by eliminating much of the waste resulting from defects in the casting and by substantially reducing the amount of chamber finishing work which is necessary. In addition, because of the thin wall construction of the liner 92, precise port edges 923, 924 and 925 are provided, which are not only resistant to wear, but also guarantee a technologically efficient streamlined fiber flow through the resulting apparatus and its ports.

As shown, in particular by FIGS. 3 through 9, the sliding surface construction of the present invention can be varied for adaptation to many different types of construction for resolving devices. However, a common characteristic of all the embodiments is that the pressure member 4, 7 or 75 has a sliding surface and it is mounted so that such surface can slide on a sliding surface 15, 9, 90 or 91 located on the resolving roller housing 1 or 102, and that contact of such sliding surfaces is maintained in all positions of the pressure member through which it moves to adjust to silver variations. The biasing means can be resilient members, such as springs or hydraulic cylinders or the sliding surfaces can be magnetizable. As shown, the sliding surfaces can be arcuate or planar.

Whatever the contour of the sliding surfaces, the housing sliding surface portions which form the upper and lower margins of the sliver infeed opening circumferentially of the resolving roller are parallel to the corresponding tangents to the adjacent portions of the resolving roller periphery; i.e. the tangent to the roller periphery perpendicular to the roller radial plane intersected by the circumferential housing opening margin and such margin are substantially parallel. Since the pressure member sliding surface is complemental to and overlaps the margin of such opening and effectively reduces the infeed opening, its sliding surface will have the same tangent parallel relationship. Such relationship assures that there will be no corners or crevices formed during the relative movement of the sliding surfaces to entrap fibers. In each instance, fiber loss is avoided and fibers will not lodge between the pressure member and the housing wall.

We claim:

1. Sliver resolving apparatus for an open-end spinning device including a resolving roller, a housing having a chamber for receiving the resolving roller, the wall of such chamber encircling the resolving roller periphery, such housing further having a plurality of openings therethrough communicating with the housing chamber, one of such openings being a silver infeed opening and another of such openings being a fiber discharge opening, and a fiber passage between the roller periphery and the chamber wall for travel of resolved fiber from the sliver infeed opening to the fiber discharge opening in one circumferential direction, the improvement comprising thin wear-resistant liner means disposed in the housing chamber spaced from the resolving roller periphery substantially covering the housing chamber wall and forming the side of the fiber passage nearest the chamber wall, said liner means including a plurality of ports, one of said ports being a sliver infeed port and another of said ports being a fiber discharge port, said liner means being disposed with said ports aligned with the corresponding housing openings.

2. The sliver resolving apparatus defined in claim 1, in which the area of each liner means port is less then the area of the corresponding housing opening, and the liner means is disposed with the port perimetral margins extending beyond the housing opening perimetral edges.

3. The sliver resolving apparatus defined in claim 1, in which the liner means is resiliently deformable.

4. The sliver resolving apparatus defined in claim 3, in which the liner means is an arcuately bent resilient strip with its ends disposed in closely adjacent, substantially parallel relationship.

5. The sliver resolving apparatus defined in claim 4, in which the liner means adjacent ends are disposed between the fiber discharge port and the silver infeed port in the direction of fiber travel.

6. The sliver resolving apparatus defined in claim 1, in which the liner means is adhesively bonded to the housing chamber wall.

7. The sliver resolving apparatus defined in claim 1, the plurality of housing openings including a dirt discharge opening between the sliver infeed opening and the fiber discharge opening in the direction of fiber travel, the improvement further comprising the plurality of liner means ports including a dirt discharge port aligned with the dirt discharge opening, said port margin having a dirt separating lip on its side nearest the fiber discharge opening.

8. The sliver resolving apparatus defined in claim 7, in which the liner means is substantially concentric with the resolving roller periphery and includes an eccentric portion forming a widened passage portion extending substantially from the dirt discharge port to the fiber discharge port.

9. The sliver resolving apparatus defined in claim 1, in which the liner means is substantially concentric with the resolving roller periphery and includes an eccentric portion immediately preceding the fiber discharge port in the direction of fiber passage forming a widened passage portion.

10. The sliver resolving apparatus defined in claim 1, and sliver feed mechanism for feeding sliver to the housing chamber including a supply roller, a pressure member movable relative to the supply roller in response to variations in the sliver and biasing means biasing the pressure member toward the supply roller, the improvement further comprising first sliding surface means surrounding the housing infeed opening margin, the portions of said first sliding surface means immediately adjacent to the housing infeed opening margin circumferentially of the resolving roller being disposed substantially parallel to adjacent tangential planes of the resolving roller periphery, second sliding surface means carried by the pressure member having a contour complemental to the contour of said first sliding surface means and having an extent sufficient to overlap the housing opening margin in all positions of the movable pressure member, and contact-maintaining means for maintaining said first and second sliding surface means in constant sliding contact.

11. The sliver resolving apparatus defined in claim 10, in which the area of the liner means silver infeed port is less than the area of the corresponding housing opening and the liner means is disposed with the port perimetral margin extending beyond the housing sliver infeed opening perimetral edge, the first sliding surface means being on said liner means sliver infeed port perimetral margin.

12. Sliver resolving apparatus for an open-end spinning device including a resolving roller, a housing having a chamber for receiving the resolving roller, the walls of such chamber being substantially concentric with the resolving roller periphery and forming therewith a fiber passage, such housing further having a sliver infeed opening, and sliver feed mechanism for feeding sliver to the housing chamber including a supply roller, a pressure member movable relative to the supply roller in response to variations in the sliver and biasing means biasing the pressure member toward the supply roller, the improvement comprising first sliding surface means on the housing surrounding the housing infeed opening margin, the portions of said first sliding surface means immediately adjacent to the housing infeed opening margin circumferentially of the resolving roller being disposed substantially parallel to adjacent tangential planes of the resolving roller periphery, second sliding surface means carried by the pressure member having a contour complemental to the contour of said first sliding surface means and having an extent sufficient to overlap the housing opening margin in all positions of the movable pressure member, and contact-maintaining means for maintaining said first and second sliding surface means in constant sliding contact.

13. The sliver resolving apparatus defined in claim 12, in which the first sliding surface means is concentric with the arc of the housing chamber wall portion surrounding the infeed opening.

14. The sliver resolving appparatus defined in claim 12, in which the sliding surface means are arcuate and are relatively slidable circumferentially.

15. The sliver resolving apparatus defined in claim 14, in which the arcuate sliding surface means are substantially concentric with the axis of the resolving roller.

16. The sliver resolving apparatus defined in claim 14, in which the arcuate sliding surface means are concentric about an axis at the side of such means remote from the resolving roller.

17. The sliver resolving apparatus defined in claim 12, in which the sliding surface means are substantially planar and are parallel to a tangential plane of the resolving roller periphery adjacent to the infeed opening.

18. The sliver resolving apparatus defined in claim 12, in which the first sliding surface faces away from the resolving roller.

19. The sliver resolving apparatus defined in claim 12, in which the first sliding surface means in faired into the housing chamber wall.

20. The sliver resolving apparatus defined in claim 12, in which the first sliding surface means faces toward the resolving roller, shield means disposed in the housing chamber overlying the first sliding surface means and carrying the second sliding surface means, the shield means margins being tapered toward the housing chamber wall circumferentially of the resolving roller, and connecting means extending through the housing infeed opening connecting said shield means and the pressure member.

21. The sliver resolving apparatus defined in claim 12, and thin liner means lining the wall of the housing chamber and having an infeed opening therethrough aligned with but smaller than the housing infeed opening, the first sliding surface means being on said liner means.

22. The sliver resolving apparatus defined in claim 12, in which the contact-maintaining means are resilient biasing means.

23. The sliver resolving apparatus defined in claim 22, the resilient biasing means including a resilient member having a unidirectional force directed toward and substantially perpendicular to a liner connecting the axes of the resolving roller and the supply roller and constituting both the biasing means and the contact-maintaining means.

24. The sliver resolving apparatus defined in claim 22, and a sliver feed interrupting lever operable to move the pressure member away from the supply roller, the improvement comprising the contact-maintaining means being a resilinet member having a unidirectional force, said resilient member reacting between the pressure member and the sliver feed interrupting lever.

25. The sliver resolving apparatus defined in claim 12, and stop means for limiting movement of the pressure member by the biasing means toward the supply roller.

* * * * *

UNITED STATES PATENT OFFICE

CERTIFICATE OF CORRECTION

Patent No. 4,024,699 Dated May 24, 1977

Inventor(s) Georg Goldammer et al.

It is certified that error appears in the above-identified patent and that said Letters Patent are hereby corrected as shown below:

Column 13, line 41, cancel "silver" and insert -- sliver --.

Column 14, line 3, cancel "silver" and insert -- sliver --; line 50, cancel "silver" and insert -- sliver --.

Column 15, line 22, cancel "appparatus" and insert -- apparatus --.

Column 16, line 2, cancel "in faired" and insert -- is faired --; line 26, cancel "liner" and insert -- line --.

Signed and Sealed this twenty-third Day of August 1977

[SEAL]

Attest:

RUTH C. MASON
Attesting Officer

C. MARSHALL DANN
Commissioner of Patents and Trademarks